United States Patent [19]

Lawson, Jr. et al.

[11] 4,424,657

[45] Jan. 10, 1984

[54] APPARATUS AND METHOD FOR CARDING PIERCED EARRINGS AND THE LIKE

[75] Inventors: Frank V. Lawson, Jr., Cumberland; Joseph C. Dionne, North Providence, both of R.I.

[73] Assignee: R. N. Koch, Inc., Providence, R.I.

[21] Appl. No.: 319,750

[22] Filed: Nov. 9, 1981

[51] Int. Cl.[3] ..... B65B 29/00

[52] U.S. Cl. ..... 53/111 R; 53/580; 53/390; 198/752; 198/766

[58] Field of Search ..... 53/580, 428, 390, 393, 53/448, 111 R; 198/752, 766, 769, 771; 209/682, 683; 188/378; 367/165

[56] References Cited

U.S. PATENT DOCUMENTS 3,472,356 10/1969 Reppert ..... 198/752

*Primary Examiner*—Francis S. Husar
*Assistant Examiner*—David B. Jones
*Attorney, Agent, or Firm*—Salter & Michaelson

[57] ABSTRACT

Apparatus and method for expediting the carding of jewelry items comprising piercing posts and clutches, such as pierced earrings and the like, particularly where a plurality of pairs of earrings are mounted on a single card. The clutches are vibrated into apertures in a plate member in proper orientation to receive the posts, with the alignment of said apertures registering with openings in the card, whereby when the card is properly positioned on the plate and the posts inserted through the card openings, the posts will frictionally engage the clutches.

2 Claims, 9 Drawing Figures

APPARATUS AND METHOD FOR CARDING PIERCED EARRINGS AND THE LIKE

BACKGROUND AND SUMMARY OF THE INVENTION

The instant invention relates to the carding of ornamental jewelry and more particularly to an apparatus for orienting jewelry clutches and the like in a predetermined array and a method for mounting the clutches on the posts of pierced earrings and the like simultaneously with the carding of the earrings.

The high cost of labor has always been a major consideration in the jewelry industry, particularly in the carding of jewelry items embodying piercing posts and clutches, such as pierced earrings, lapel and stick pins etc. The problem presented during these carding operations become magnified where a large number of such jewelry items are to be mounted on a single card. More particularly, this operation has involved the individual handling of each of the minature clutches and the mounting of same on their respective posts after the jewelry items have been mounted on the card with the posts extending therethrough. Accordingly, in large scale jewelry operations, this assembly step has represented a significant factor in the overall cost of manufacturing and carding jewelry items of this type.

The apparatus and method of the instant invention therefore represent significant advancements in the field of costume jewelry manufacture by substantially reducing the cost of labor involved in assembling jewelry clutches and the like on the corresponding posts of jewelry items, while simultaneously carding the items. In particular, the instant invention achieves this purpose by providing an apparatus for orienting a plurality of the clutches in a predetermined array on a generally planar plate having a plurality of apertures therein whereby a plurality of the jewelry items may be quickly and easily assembled with the clutches at the same time the items are carded. Once the clutches are properly oriented, the carding operation is effected by superimposing the cards over the plate so that the mounting holes in the cards are in registry with the clutches. The posts of the items are then simply inserted through the cards to effect assembly with the corresponding clutches therebehind.

The apparatus of the instant invention therefore includes a generally planar plate having a plurality of apertures therethrough as hereinabove mentioned. The apertures are dimensioned to receive the rear portions only of conventional jewelry clutches of the type having enlarged facing portions and reduced rear portions. A retaining wall is provided around the periphery of the plate and conventional means are provided for vibrating the plate. Accordingly, when a plurality of the jewelry clutches are positioned on the upper plate surface, vibration of the plate by the vibrating means causes vibratory movement of the clutches so that they randomly fall or drop into the apertures with the reduced rear portions of the clutches in the apertures and the enlarged facing portions thereof adjacent to the upper surface of the plate and upwardly disposed. When all of the apertures are filled with clutches, the excess clutches are removed from the plate surface by conventional means leaving only the properly oriented clutches. The assembly of the clutches to the jewelry items may then be completed as hereinabove described.

The apparatus herein disclosed has proven extremely effective for substantially reducing the labor cost in assembling the above mentioned jewelry items with clutches while effecting the carding thereof, particularly where a substantial number of such jewelry items are being mounted on one card. Specifically, it has been found that an operator using the apparatus and method of the instant invention can assembly as many as 60 to 70 jewelry cards each having 18 pierced earrings thereon during the course of an hour. By comparison the same operator could only assembly about 25 such cards during the course of an hour using conventional manual techniques or about 38 such cards where automatic clutch feed is utilized. Accordingly, it is seen that the apparatus and method of the instant invention represent significant advancements in the field of jewelry manufacture as a result of the substantial savings realized in the cost of labor.

It is therefore an object of the instant invention to provide an apparatus to expedite the assembly of jewelry clutches and the like on the posts of corresponding jewelry items, while simultaneously carding the items.

Another object of the invention is to provide an apparatus for orienting jewelry clutches and the like in a predetermined array to facilitate the assembly thereof with jewelry items while the items are simultaneously carded.

Another object of the invention is to provide an apparatus and method for reducing the cost of labor in the carding of pierced earrings and the like.

A still further object of the instant invention is to provide an efficient method for assembling jewelry clutches and the like onto the corresponding posts of jewelry items, while simultaneously carding said items.

Other objects, features and advantages of the invention shall become apparent as the description thereof proceeds when considered in connection with the accompanying illustrative drawings.

DESCRIPTION OF THE DRAWINGS

In the drawings which illustrates the best mode presently contemplated for carrying out the present invention.

DESCRIPTION OF THE INVENTION

Figure 1:
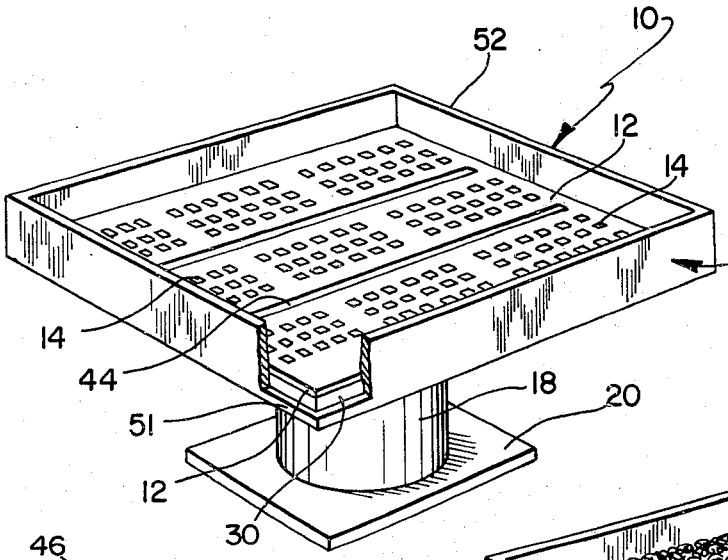
FIG. 1 is a perspective view of the apparatus of the instant invention.
Figure 2:
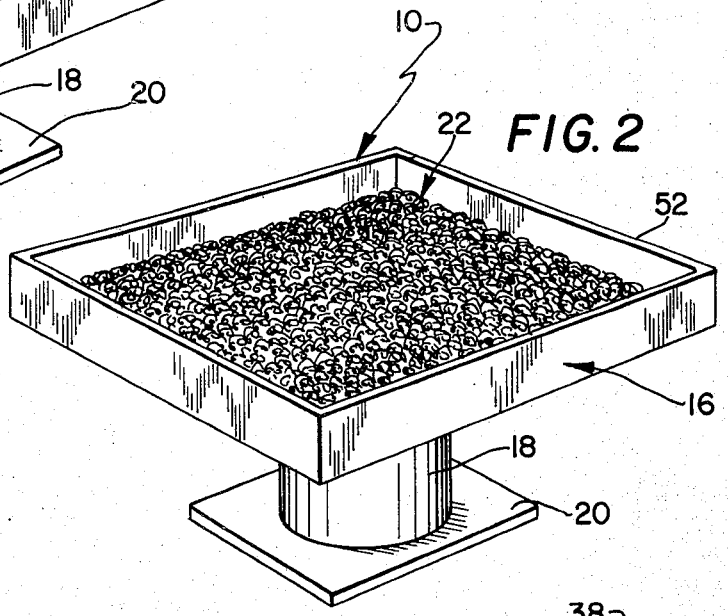
FIG. 2 is a perspective view thereof with a plurality of jewelry clutches on the upper plate surface of the apparatus.
Figure 5:
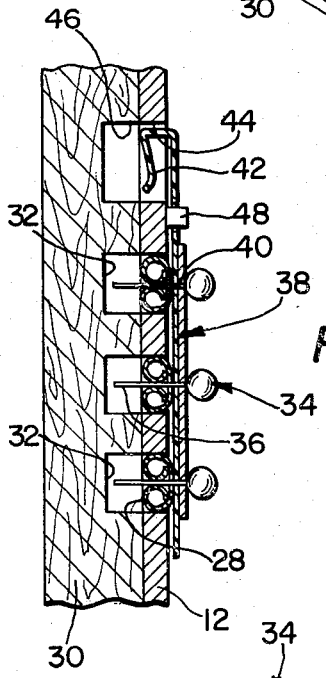
FIG. 5 is a sectional view taken along line 5—5 in FIG. 4.
Figure 6:
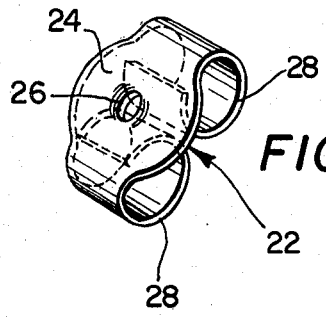
FIG. 6 is a perspective view of a jewelry clutch member per se.
Figure 8:
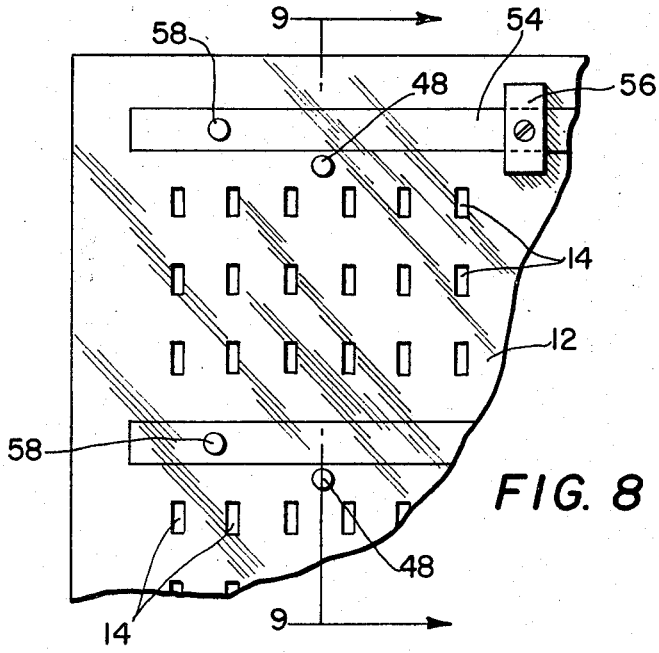
FIG. 8 is a fragmentary top plan view of a plate with filler strips positioned in the slots therein.
Figure 9:
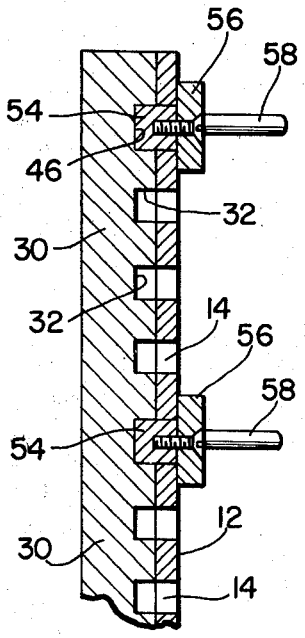
FIG. 9 is a sectional view taken along line 9—9 in FIG. 8.

Referring now to the drawings, the apparatus of the instant invention is generally indicated at 10 in FIGS. 1 and 2. The apparatus 10 includes a substantially planar top plate 12 having a plurality of apertures 14 therein, mounted within an open housing or frame 16. The housing 16 is mounted on a vibrator pedestal 18 which is supported by a base 20. In operation, a plurality of jewelry clutches of the type generally indicated at 22 in FIG. 6 are positioned on the plate 12 and the plate 12 is vibrated. Vibration of the plate 12 causes vibratory movement of the clutches 22 so that they randomly fall or drop into the apertures 14 to effect their desired orientation.

Referring particularly to FIGS. 3 through 9, it is seen that the plate 12 is specifically designed for use in orienting clutches of the type illustrated in FIG. 6 at 22. In this connection it is noted that each of the clutches 22 comprises an enlarged facing portion 24 having an aperture or opening 26 therethrough and a reduced rear portion which is defined by opposed rearwardly and inwardly curled spring members 28. The apertures 14 are dimensioned to receive the spring members 28 but not the facing portions 24. Accordingly, the width of the apertures 14 must be slightly greater than the width of the spring members 28, but slightly less than the width of the facing portions 24. The length of the apertures 14 is obviously dictated by the overall length of the clutches 22.

Preferably the plate 12 is made of aluminum or some other suitable metal and is adhered to a dampening board 30 having a plurality of channels 32 therein which are in communication with the apertures 14 to provide necessary clearance therebehind. The apertures 14 are arranged as desired for particular jewelry carding operations. In this regard the apparatus 10 as herein illustrated is adapted for carding and assembling pierced earrings 34 having rearwardly extending posts 36 on substantially rectangular jewelry cards 38 having aligned rows of openings 40 for the pins 36 and having rearwardly extending hanger flanges 42. Therefore the apertures 14 are disposed in aligned rows on the plate 12 so that when the apertures 14 contain clutches 22 and a card 38 is overlaid on the plate 12 in proper aligned relation, the openings 40 in the card are in registry with the clutch apertures 26 so that the posts 36 may be inserted into the apertures 26 merely by inserting them into the openings 40. To facilitate the overlaying and proper orientation of the cards 38 on the plate 12, slots 44 are provided in the plate 12, there being corresponding slots 46 in the board 30 therebehind for receiving the hanger flanges 42. Registration pins 48 which are receivable in hanger holes 50 on the cards 38 extend upwardly from the plate to facilitate the desired registration of the cards 38 on the plate 12.

As seen from FIG. 1, the plate 12 and the board 30 are mounted within the housing 16. In this connection the housing 16 includes a bottom wall 51 to which the plate 12 and the board 30 are removably attached with conventional means (not shown) and upstanding retaining walls 52 which extend around the perimeter of the plate 12. The wall 51 is mounted on the vibrator housing 18 which houses a conventional vibrating device (not shown) which may be of the type marketed by F.M.C. Corp. as a Syntron platform paper jogger. The vibrating device is mechanically connected to the housing 16 so that upon energization thereof, vibration of the housing 16 and the plate 12 therein is effected.

Figure 4:
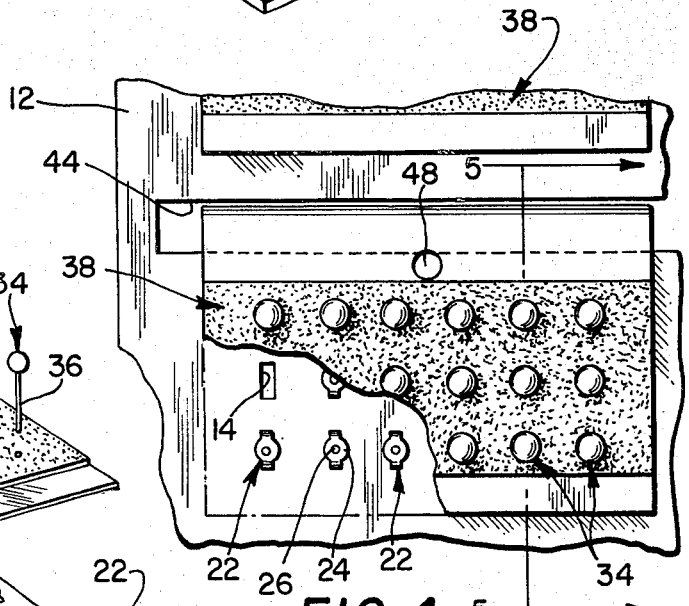
FIG. 4 is a fragmentary top plan view of the plate with a card thereon with a portion of the card broken away for purposes of illustration.
Figure 3:
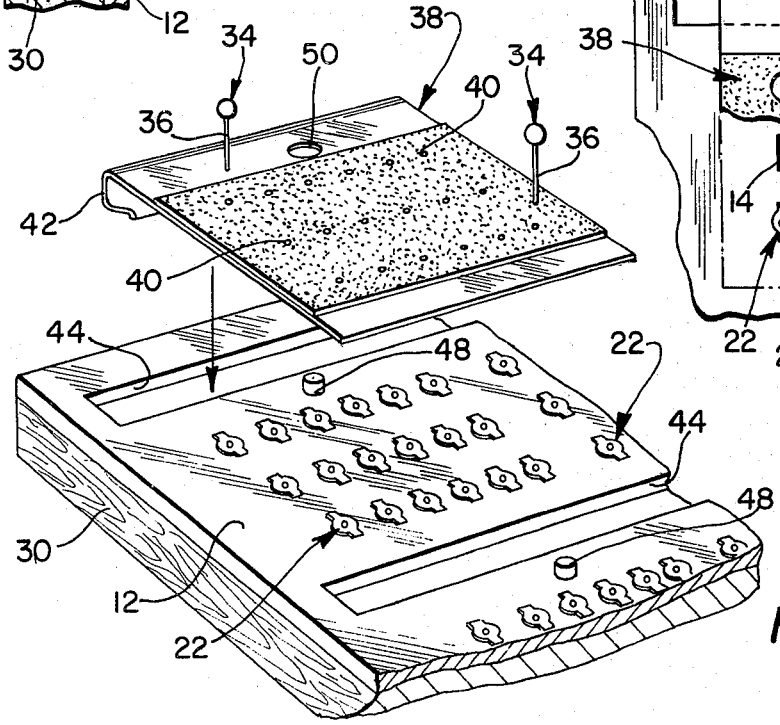
FIG. 3 is an exploded fragmentary perspective view illustrating the overlaying of a jewelry card on the upper plate surface of the apparatus after the clutches have been positioned in the apertures therein.
Figure 7:
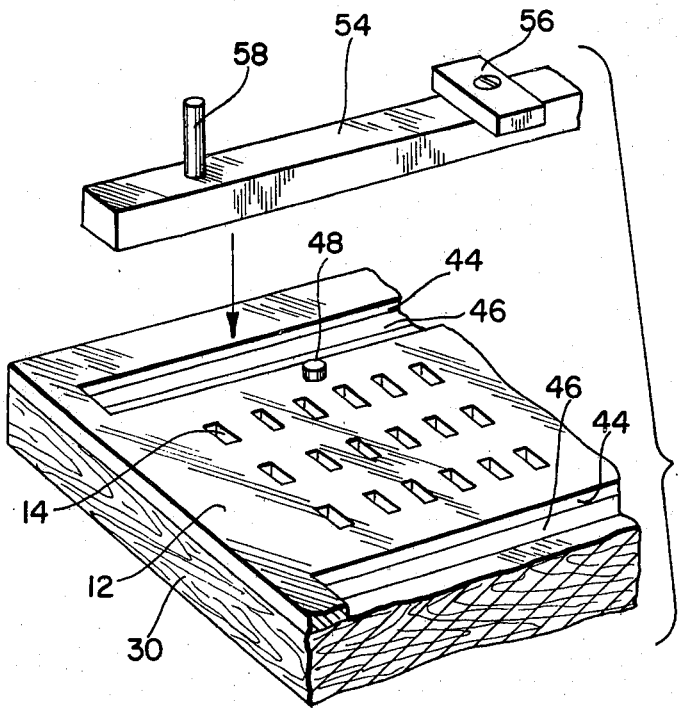
FIG. 7 is an exploded fragmentary perspective view of an apertured plate mounted on a board illustrating the positioning of a filler strip in a slot in the plate.

In operation, a plurality of the clutches 22 are placed on the plate 12 and the vibrator device within the housing 18 is energized to effect vibratory traveling movement of the clutches 22 on the plate 12. This random movement of the clutches 22 causes them to randomly fall or drop into the apertures 14 whereby they are disposed in desired array on the plate 12 with the spring members 28 in the apertures 14 and with the facing portions 22 resting on the upper plate surface as illustrated in FIGS. 3 and 4. In order to prevent the clutches 22 from dropping into the channels 24, filler strips 54 having transverse retainer brackets 56 and upstanding handle posts 58 are positioned therein during the vibrating operation. In this regard preferably the upper surfaces of the strips 54 are substantially coplanar with the upper surface of the plate 12 to permit free movement of the clutches 22 thereacross.

Since the plate 12 is preferably made of aluminum or some other metal, undampened vibration thereof tends to be excessively sharp whereby a significant number of the clutches 22 may be vibrated out of the apertures 14 after they have been properly oriented therein during the vibrating operation. For this reason, the plate 12 is adhered to the dampening board 30 which is preferably made of a fibrous material such as a hardwood laminate or the like. The composite board comprising the plate 12 and the dampening board 30 vibrates substantially less sharply so that the tendency for the clutches to vibrate out of the aperture is substantially reduced.

In actual operation it has proven desirable to initially position a substantially greater number of the clutches 22 on the board 12 than there are apertures 14 therein. In particular, it has been found that best results are obtained when approximately eight times more clutches are provided than the number of apertures 14 in order to achieve substantially complete filling of the apertures within a reasonable time period of vibration; and specifically, it has been found that approximately 90 seconds of vibration will cause substantially all of the apertures 14 to be filled. The vibrating device is then deenergized and the excess clutches removed from the upper surface of the plate 12 by any conventional means. Any of the apertures 14 which do not contain clutches 22 are manually filled at this time and the filler strips 54 are removed from the plate 12. The plate 12 with the clutches 22 therein is then removed from the apparatus 10 and the cards 38 are overlaid thereon as illustrated most clearly in FIGS. 3 and 5. When the cards 38 are properly oriented with respective hanger flanges 42 in the slots 44 and 46 and the pins 48 in the holes 50, the posts 36 of the earrings 34 are then inserted through the openings 42 in the cards 38 whereby they automatically enter into the openings 26 in the clutches 22 therebehind. When earrings 34 have been inserted into all of the holes 40 in the cards 38, the cards 38 and the earrings 34 with the clutches attached thereto may be removed from the plate 12.

It is seen therefore that the instant invention provides an effective method and apparatus for mounting clutches on pierced earrings and the like while simultaneously effecting the carding of the earrings. The apparatus and method have proven particularly effective for reducing the cost of labor in the carding of costume jewelry such as pierced earrings, and particularly where a number of pairs of earrings are mounted on a single card. The instant invention is therefore of notable commercial significance in the highly competitive costume jewelry industry.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An apparatus for orienting jewelry clutches and the like of the type having enlarged facing portions and reduced rear portions, in a predetermined array, said apparatus comprising:

a. a generally horizontally disposed, substantially flat planar plate having a plurality of apertures therethrough, said apertures being disposed to define said array and each being dimensioned to receive the rear portion of a clutch or the like with the corresponding facing portion of the clutch adjacent to the top surface of said plate;

b. retaining means extending substantially around the periphery of said plate for retaining clutches and the like on the upper plate surface;

c. vibrating means for vibrating said plate to cause jewelry clutches or the like disposed on the upper surface of said plate to be randomly moved, and reoriented thereon, whereby at least a portion of the rear portions of said clutches fall into said apertures, said plate further characterized as a metallic plate, said apparatus further comprising a fibrous dampening board having at least one recess in the upper surface thereof, said plate being adhered to said board in overlying relation with the apertures in the plate in communication with said recess to provide clearance beneath the apertures, said board acting to slightly dampen the vibration of said plate to further promote the desired orienting of the clutches or the like.

2. An apparatus for orienting jewelry clutches and the like of the type having enlarged facing portions and reduced rear portions, in a predetermined array, said apparatus comprising:

a. a generally horizontally disposed, substantially flat planar plate having a plurality of apertures therethrough, said apertures being disposed to define said array and each being dimensioned to receive the rear portion of a clutch or the like with the corresponding facing portion of the clutch adjacent to the top surface of said plate;

b. retaining means extending substantially around the periphery of said plate for retaining clutches and the like on the upper plate surface;

c. vibrating means for vibrating said plate to cause jewelry clutches or the like disposed on the upper surface of said plate to be randomly moved, and reoriented thereon, whereby at least a portion of the rear portions of said clutches fall into said apertures, and a registration pin extending upwardly from the upper surface of said plate for orienting a jewelry card or the like on said plate, said card being of the type having an aperture therethrough for receiving said pin and having a plurality of jewelry items received thereon, said items having posts which extend rearwardly through said card and being oriented on said card so that they are receivable in clutches in said plate apertures when said card is overlaid on said plate with said pin in said card aperture.

* * * * *